US005813460A

United States Patent [19]

Ringgenberg et al.

[11] Patent Number: 5,813,460

[45] Date of Patent: Sep. 29, 1998

[54] FORMATION EVALUATION TOOL AND METHOD FOR USE OF THE SAME

[75] Inventors: Paul D. Ringgenberg, Carrollton, Tex.; Roger Lynn Schultz, Stillwater, Okla.; Neal G. Skinner, Lewisville, Tex.; Margaret C. Waid, Houston, Tex.; Curtis E. Wendler, Carrollton, Tex.; Robert W. Srubar, Kathy, Tex.

[73] Assignee: Halliburton Energy Services, Inc., Dallas, Tex.

[21] Appl. No.: 657,236

[22] Filed: Jun. 3, 1996

[51] Int. Cl.[6] ..... E21B 33/124; E21B 49/10

[52] U.S. Cl. ..... 166/250.17; 166/264; 166/191

[58] Field of Search ..... 166/323, 169, 166/186, 191, 264, 250.17, 387; 175/58, 59

[56] References Cited

U.S. PATENT DOCUMENTS

| | | | |
|---|---|---|---|
| 2,824,612 | 2/1958 | Lynes | 166/191 X |
| 4,313,495 | 2/1982 | Brandell | 166/53 |
| 4,817,723 | 4/1989 | Ringgenvberg | 166/323 X |

OTHER PUBLICATIONS

New Halliburton CR (Continuous Retrievable) Sampler, Nov. 1959.

*World Oil* "New Test Tool Samples Several Zones in one Trip" May 1960.

*Primary Examiner*—David J. Bagnell

*Attorney, Agent, or Firm*—William M. Imwalle; Paul I. Herman; Lawrence R. Youst

[57] ABSTRACT

A downhole tool for early formation evaluation is disclosed. The tool comprising a housing having a fluid passageway and a mandrel having an interior volume. The mandrel is slidably disposed within the housing and has a plurality of axial positions relative to the housing. The mandrel is slidably operated responsive to the fluid pressure within the interior volume such that the mandrel cycles through said plurality of positions. A retractor sleeve is operably associated with the housing and the mandrel for engaging the mandrel and slidably urging the mandrel relative to the housing. The retractor sleeve is slidably operated responsive to the fluid pressure within the interior volume. A seal assembly is slidably disposed around the housing. The seal assembly includes a floating piston. A chamber is formed between the housing and the floating piston that is in communication with the fluid passageway of the housing such that the fluid pressure within the interior volume enters the chamber and slidably urges the seal assembly, thereby stretching the seal assembly.

35 Claims, 13 Drawing Sheets

FORMATION EVALUATION TOOL AND METHOD FOR USE OF THE SAME

TECHNICAL FIELD OF THE INVENTION

This invention relates, in general, to a formation evaluation tool and, in particular to, a downhole tool having a retractor sleeve operably associated with a housing and a mandrel for engaging the mandrel and slidably urging the mandrel relative to the housing in response to changes in the fluid pressure within the downhole tool.

BACKGROUND OF THE INVENTION

Without limiting the scope of the invention, its background is described in connection with drilling an oil or gas well, as an example.

During the course of drilling an oil or gas well, one operation which is often performed is to lower a testing string into the well to test the production capabilities of hydrocarbon producing underground formations intersected by the well. Testing is typically accomplished by lowering a string of pipe, generally drill pipe or tubing, into the well with a packer attached to the string at its lower end. Once the test string is lowered to the desired final position, the packer is set to seal off the annulus between the test string and the wellbore or casing, and the underground formation is allowed to produce oil or gas through the test string.

It has been found, however, that more accurate and useful information can be obtained if testing occurs as soon as possible after penetration of the formation. As time passes after drilling, mud invasion and filter cake buildup may occur, both of which may adversely affect testing.

Mud invasion occurs when formation fluids are displaced by drilling mud or mud filtrate. When invasion occurs, it may become impossible to obtain a representative sample of formation fluids or at a minimum, the duration of the sampling period must be increased to first remove the drilling fluid and then obtain a representative sample of formation fluids.

Similarly, as drilling fluid enters the surface of the wellbore in a fluid permeable zone and leaves its suspended solids on the wellbore surface, filter cake buildup occurs. The filter cakes act as a region of reduced permeability adjacent to the wellbore. Thus, once filter cakes have formed, the accuracy of reservoir pressure measurements decrease affecting the calculations for permeability and produceability of the formation.

Some prior art samplers have partially overcome these problems by making it possible to evaluate well formations encountered while drilling without the necessity of making two round trips for the installation and subsequent removal of conventional tools. These systems allow sampling at any time during the drilling operation while both the drill pipe and the hole remain full of fluid. These systems, not only have the advantage of minimizing mud invasion and filter cake buildup, but also, result in substantial savings in rig downtime and reduced rig operating costs.

These savings are accomplished by incorporating a packer as part of the drill string and recovering the formation fluids in a retrievable sample reservoir. A considerable saving of rig time is affected through the elimination of the round trips of the drill pipe and the reduced time period necessary for hole conditioning prior to the sampling operations.

These samplers, however, are limited in the volume of samples which can be obtained due to the physical size of the sampler and the tensile strength of the wire line, slick line or sand line used in removal of the sampler. In addition, prior art samplers have often been unable to sufficiently draw down formation pressure to clean up the zone and quickly obtain a representative sample of the formation fluids. Further, these prior art samplers are limited to a single sample during each trip into the wellbore.

Therefore, a need has arisen for an apparatus and a method for obtaining a plurality of representative fluid samples and taking formation pressure measurements from one or more underground hydrocarbon formations during a single trip into the wellbore using pressure to control the operation of the apparatus. A need has also arisen for a cost effective formation evaluation tool and a cost effective method to evaluate a formation during a drilling operation.

SUMMARY OF THE INVENTION

The present invention disclosed herein comprises a downhole tool having a housing, a mandrel slidably disposed within the housing and a retractor sleeve operably associated with the housing and the mandrel for engaging the mandrel and slidably urging the mandrel relative to the housing. The mandrel and the retractor sleeve are both slidably operated responsive to changes in the fluid pressure within the downhole tool, which cause the mandrel and the retractor sleeve to move axially relative to the housing.

The retractor sleeve defines at least one external slot which accepts at least one pin radially extending from the housing. The radially extending pin guides the relative rotational motion between the retractor sleeve and the housing as the retractor sleeve slides axially relative to the housing.

A torsion spring having first and second ends is operably associated with the retractor sleeve and the mandrel. The first end of the torsion spring is securably attached to the retractor sleeve. The second end of the torsion spring is slidably rotatable relative to the retractor sleeve. The first end and the second end of the torsion spring have a plurality of rods extending therebetween, allowing relative rotational motion between the first end and the second end of the torsion spring.

Located on the outer surface of the mandrel is at least one external hook. Located on the inner surface of the second end of the torsion spring is at least one internal lug which is securably engagable with the external hook of the mandrel. A coil spring disposed between the housing and the mandrel upwardly biases the retractor sleeve.

In operation, the mandrel is slidably operated responsive to the fluid pressure within the downhole tool. The mandrel has a plurality of positions relative to the housing such that increases in fluid pressure generally shift the mandrel downward relative to the housing. The retractor sleeve is slidably and rotatably operated responsive to the fluid pressure within the downhole tool such that the retractor sleeve, at sufficient fluid pressure levels within the downhole tool, shifts downward relative to the housing and the mandrel, engaging the internal lug of the torsion spring with the external hook of the mandrel. The coil spring upwardly biases the retractor sleeve and the mandrel as the fluid pressure within the downhole tool is decreased, thereby upwardly shifting the mandrel and the retractor sleeve relative to the housing.

BRIEF DESCRIPTION OF THE DRAWINGS

For a more complete understanding of the present invention, including its features and advantages, reference is now made to the detailed description of the invention taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
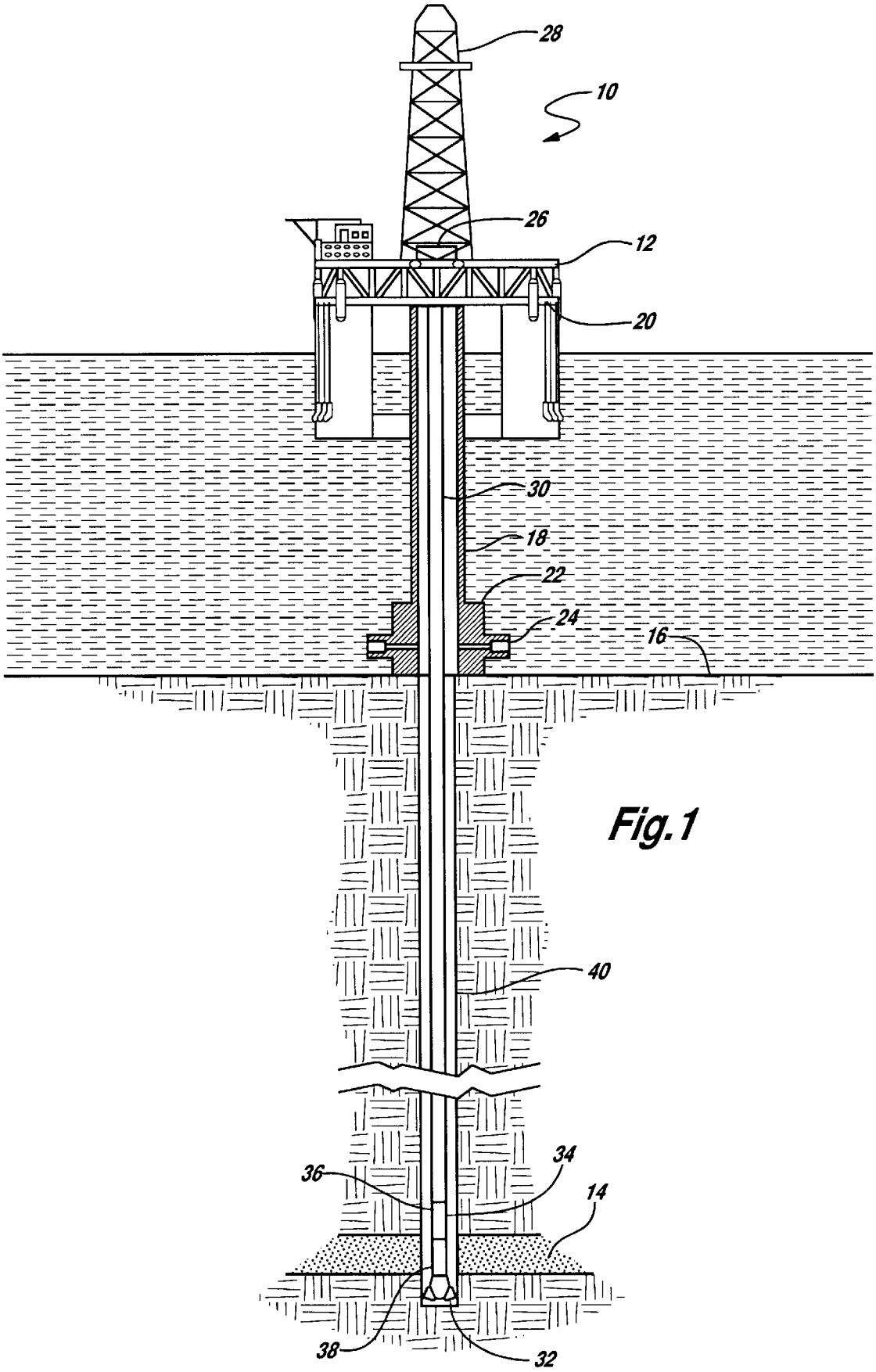
FIG. 1 is a schematic illustration of an offshore oil and gas drilling platform operating a formation evaluation tool of the present invention.
Figure 2A:
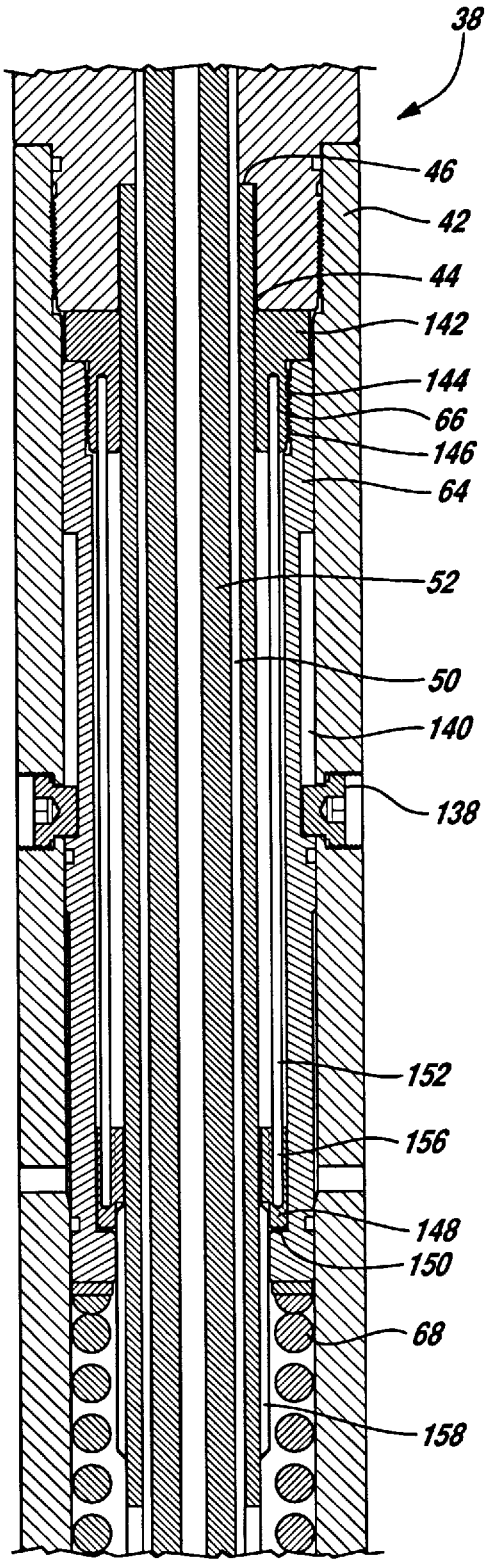
FIGS. 2A–2D are half sectional views of a formation evaluation tool of the present invention.
Figure 2B:
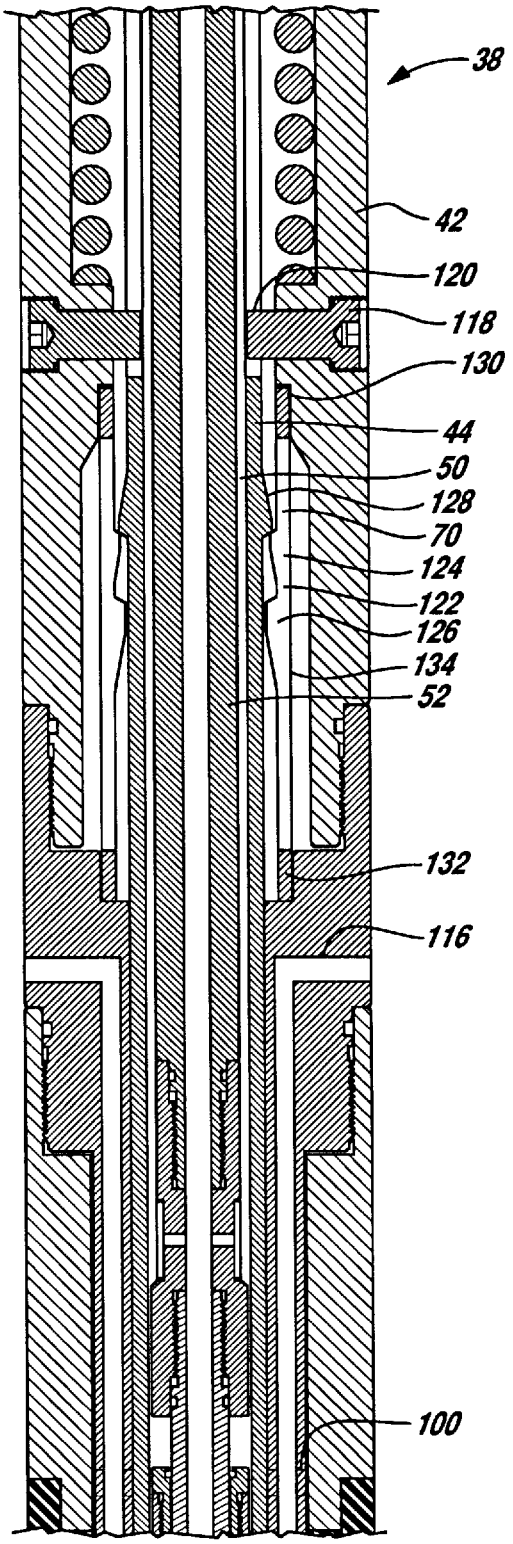
Figure 2C:
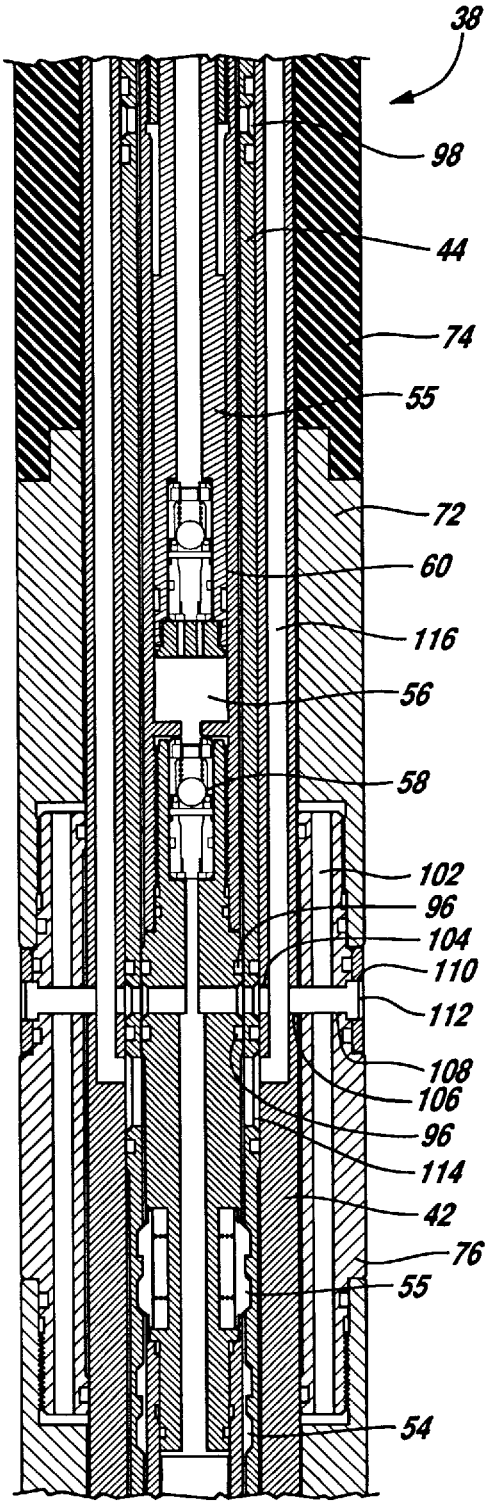
Figure 2D:
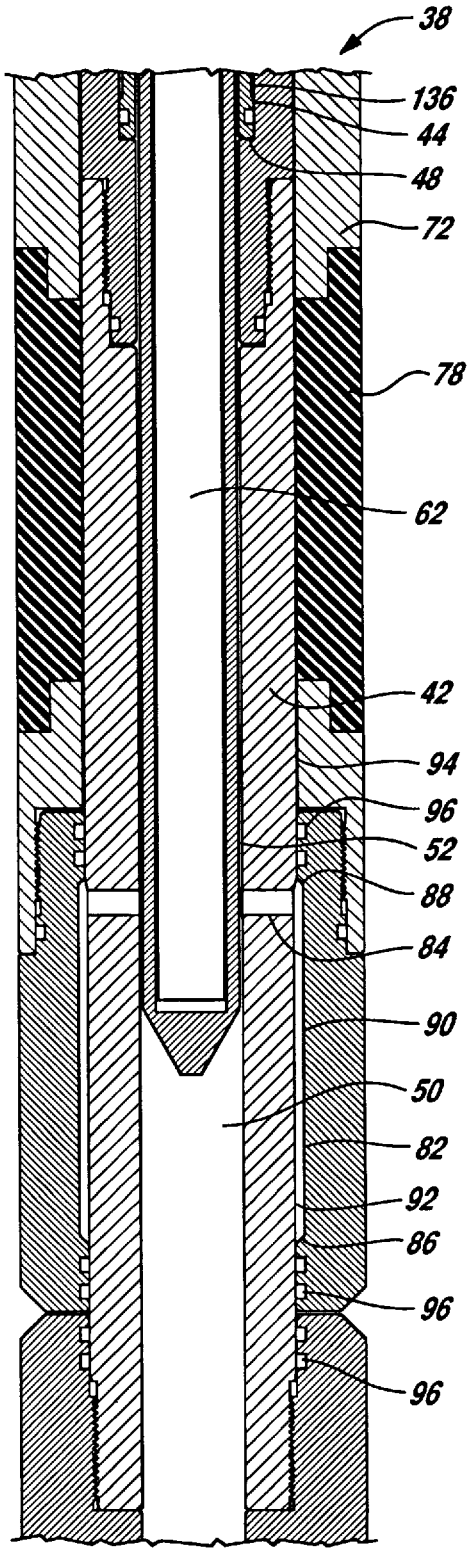

Referring to FIG. 1, a formation evaluation tool for use on an offshore oil or gas drilling platform is schematically illustrated and generally designed 10. A semisubmersible platform 12 is centered over a submerged oil and gas formation 14 located below sea floor 16. A subsea conduit 18 extends from deck 20 of platform 12 to a wellhead installation 22 including blowout preventors 24. Platform 12 has a derrick 26 in a hoisting apparatus 28 for raising and lowering drill string 30 including drill bit 32 and drilling formation evaluation and sampling tool 34.

Tool 34 includes pump assembly 36 and formation evaluation tool 38. Pump assembly 36 may comprise a pump which is operated by cycling the tubing pressure, a pump which is operated by internal flow, a pump operated by rotating the drill string, or a pump operated by repeated raising and lowering of the drill string. Pump assembly 36 may also comprise a pump operated by oscillatory motion of a power section as described in coassigned and copending U.S. patent application Ser. No. 08/657,205, filed on Jun. 3, 1996, entitled "Automatic Downhole Pump Assembly and Method for Use of the Same" which is hereby incorporated by reference.

During a drilling and testing operation, drill bit 32 is rotated on drill string 30 to create wellbore 40. Shortly after drill bit 32 intersects formation 14, drilling stops to allow formation testing before significant mud invasion or filter cake build up occurs. The tubing pressure inside drill string 30 is then regulated to operate pump assembly 36 and formation evaluation tool 38. Pump assembly 36 may be operated to draw down the formation pressure in formation 14 so that formation fluids can be quickly pumped into formation evaluation tool 38. Formation evaluation tool 38 may be operated to obtain a representative sample of formation fluid or gather other formation data with a minimum of drilling downtime. After such sampling of the formation, the tubing pressure may be further regulated to operate formation evaluation tool 38 such that drilling may resume.

Even though FIG. 1 shows formation evaluation tool 38 attached to drill string 30, it should be understood by one skilled in the art that formation evaluation tool 38 is equally well-suited for use during other well service operations. It should also be understood by one skilled in the art that formation evaluation tool 38 of the present invention is not limited to use with semisubmersible drilling platforms as shown in FIG. 1. Formation evaluation tool 38 is equally well-suited for use with conventional offshore drilling rigs or during onshore drilling operations.

Referring to FIGS. 2A–2D, formation evaluation tool 38 is depicted. Formation evaluation tool 38 comprises housing 42 which may be threadably connected with pump assembly 36 proximate the upper end of formation evaluation tool 38 as shown in FIG. 1. Formation evaluation tool 38 includes mandrel 44 which is slidably disposed within housing 42 between shoulder 46 and shoulder 48 of housing 42. Mandrel 44 defines interior volume 50 which may accept probe 52 therein. Profile 54 of mandrel 44 engages spring loaded keys 55 of probe 52 to secure probe 52 in position after probe 52 is inserted into mandrel 44. Annular seals 96 provide a seal between mandrel 44 and probe 52. Probe 52 includes chamber 56, intake valve 58, exhaust valve 60, and pressure recorder chamber 62 for containing a pressure recorder (not pictured). Intake valve 58 may be operably associated with pump assembly 36 or probe 52 may include a pump assembly.

Disposed between housing 42 and mandrel 44 is retractor sleeve 64, torsion spring 66, and coil spring 68. Retractor sleeve 64 slides axially and rotates with respect to housing 42 and mandrel 44. Torsion spring 66 is fixably secured to retractor sleeve 64 proximate the upper end of torsion spring 66 and rotatably disposed within retractor sleeve 64 proximate the lower end of torsion spring 66. Retractor sleeve 64 is upwardly biased by spring 66.

Load spring 70 is disposed between housing 42 and mandrel 44 of formation evaluation tool 38. Load spring 70 supports mandrel 44 and allows mandrel 44 to slide axially relative to housing 42.

Disposed about housing 42 is seal assembly 72. Seal assembly 72 comprises upper seal element 74, floating member 76, lower seal element 78 and floating piston 80. In operation, upper seal element 74 and lower seal element 78 isolate formation 14 from the drilling fluid above upper seal element 74 and below lower seal element 78 so that pump assembly 36 may draw down the pressure in formation 14, thereby minimizing the time needed to obtain a representative sample in a formation fluid sampling operation.

Figure 3A:
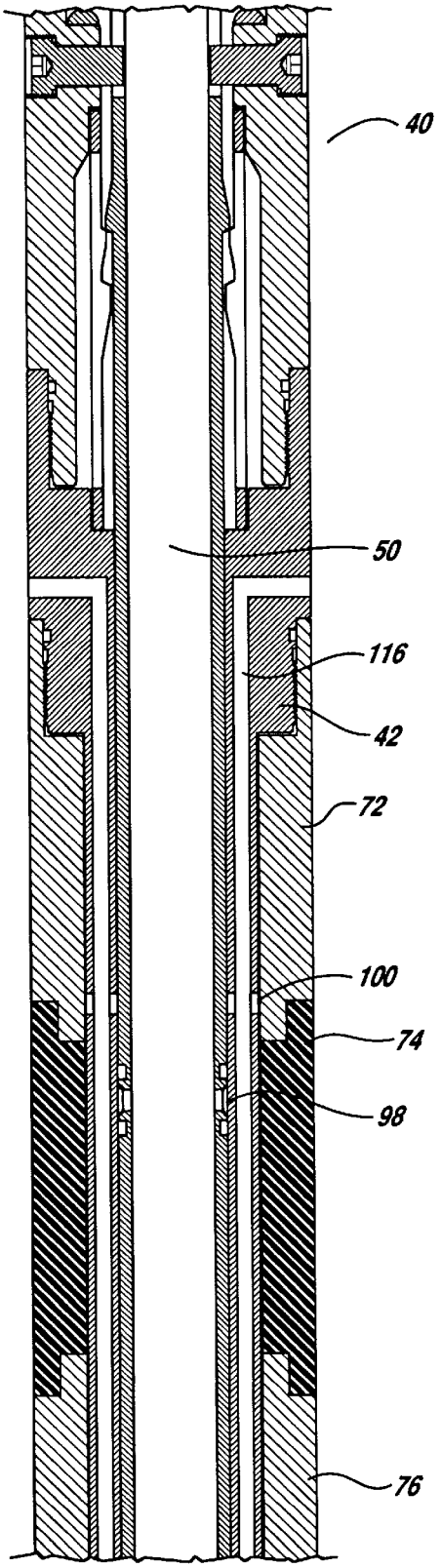
FIGS. 3A–3B are half sectional views of a seal assembly of a formation evaluation tool of the present invention.
Figure 3B:
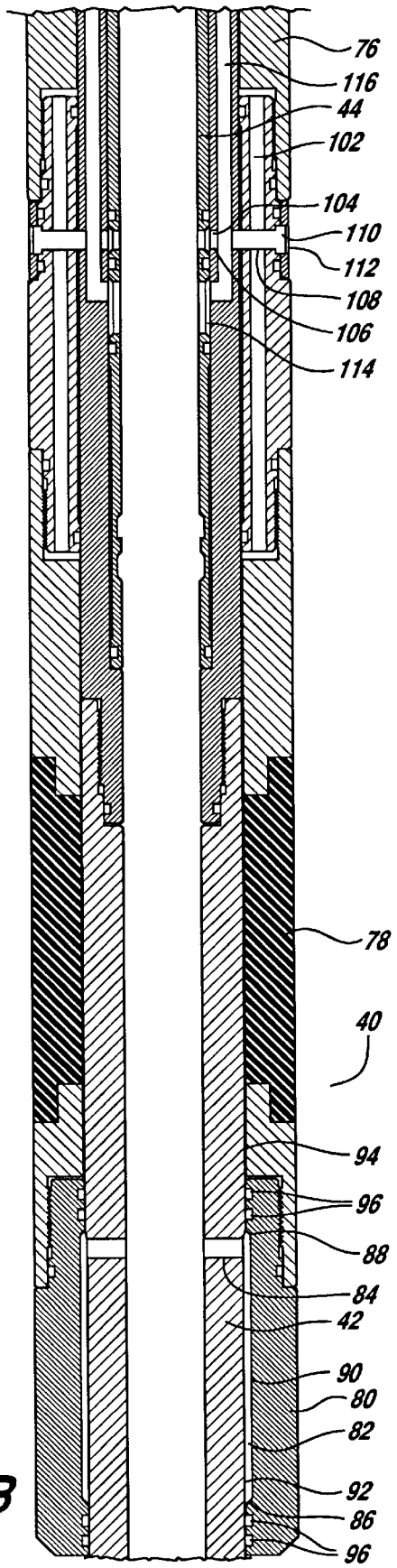

In FIG. 3, a half sectional view of seal assembly 72 is depicted. During a drilling operation, seal element 74 and seal element 78 are deflated so that seal element 74 and seal element 78 do not interfere with drilling mud circulation and are not damaged due to contact with wellbore 40. Seal assembly 72 includes floating piston 80. Floating piston 80 and housing 42 define chamber 82 which is in communication with interior volume 50 via fluid passageway 84 in housing 42. Fluid pressure from inside interior volume 50 enters chamber 82 downwardly urging floating piston 80. Floating piston 80 is downwardly urged due to the difference between the hydraulic force exerted on surface 86, and the hydraulic force exerted on surface 88. Surface 86 extends between inner diameter 90 of floating piston 80 and outer diameter 92 of housing 42. Surface 88 extends between inner diameter 90 of floating piston 80 and outer diameter 94 of housing 42 which is greater than outer diameter 92 of housing 42. Floating piston 80 downwardly urges seal assembly 72 to stretch seal assembly 72 and to further ensure that seal element 74 and seal element 78 do not interfere with the drilling operation. Above and below chamber 82 and between floating piston 80 and housing 84 are annular seals 96, such as O-rings.

Even though FIG. 3 shows seal assembly 72 as sliding axially relative to housing 42, it should be understood by one skilled in the art that seal assembly 72 may slide rotatably about housing 42.

Probe 52 may be inserted into interior volume 50 as shown in FIG. 2. After probe 52 is inserted into mandrel 44, the fluid pressure within interior volume 50 downwardly urges mandrel 44. As mandrel 44 slides downward relative to housing 42, fluid port 98 of mandrel 44 aligns with fluid passageway 100 of housing 42 allowing fluid pressure from interior volume 50 to inflate seal element 74 by traveling between seal assembly 72 and housing 42. Fluid pressure from interior volume 50 also travels through fluid passageway 102 in floating member 76 in order to inflate seal element 78. Once seal element 74 and seal element 78 are inflated and formation 14 is isolated, mandrel 42 is shifted downward to align fluid port 104 with formation fluid passageway 106 of housing 42 and formation fluid passageway 108 of floating member 76. Floating member 76 includes formation fluid port 110 which may include screen 112 to filter out formation particles. When fluid port 104 is aligned with formation fluid passageway 106, fluid port 114 is aligned with fluid passageway 116 which allows the pressure to equalize above seal element 74 and below seal element 78 through interior volume 50 and drill bit 32.

Mandrel 44 may be shifted upward relative to housing 42 aligning fluid port 114 with fluid passageway 106 and fluid passageway 116 and aligning fluid port 98 with fluid passageway 100 to deflate seal element 74 and seal element 78 by equalizing the pressure in wellbore 40 and interior volume 50.

Even though FIG. 2 depicts seal element 74 and seal element 78 as inflatable, it should be understood by one skilled in the art that a variety of seal elements are equally well-suited to the present invention including, but not limited to, compression seal elements.

Figures 4A, 4B, 4C, 4D:
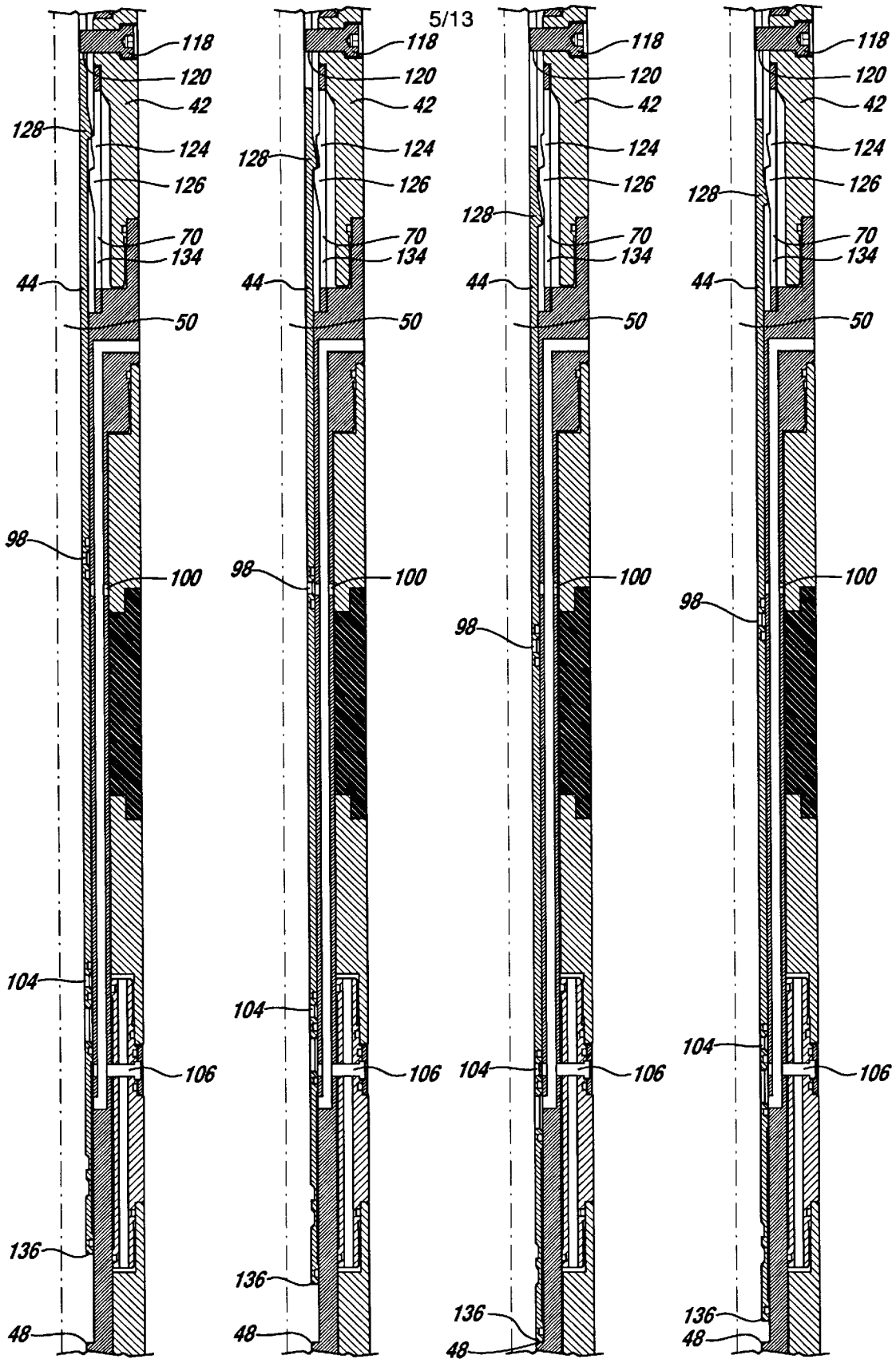
FIGS. 4A–4D are quarter sectional views of the operation of a mandrel of a formation evaluation tool of the present invention.

In FIG. 4, including FIGS. 4A–4D, the interaction between load spring 70 and mandrel 44 is depicted. Mandrel 44 receives pin 118 into slot 120 to prevent relative rotational movement between mandrel 44 and housing 42 as mandrel 44 slides axially relative to housing 42.

Between mandrel 44 and housing 42 is load spring 70. Load spring 70 has profile 122 which includes upper upset 124 and lower upset 126. Mandrel 44 includes upset 128 which interferes with upper upset 124 and lower upset 126 of load spring 70.

Figure 5:
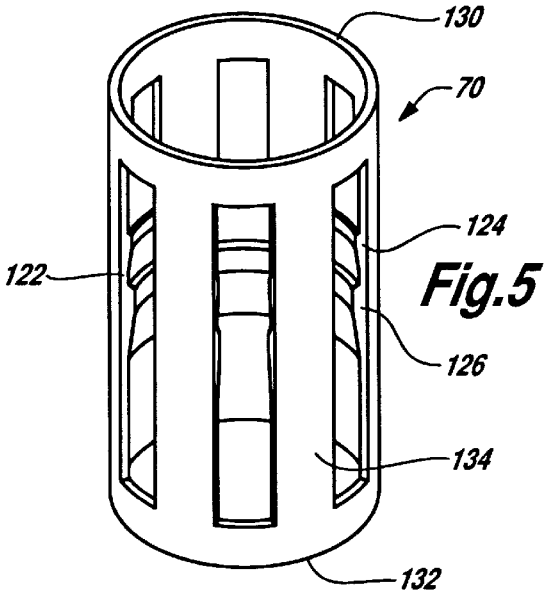
FIG. 5 is a perspective representation of a load spring of the formation evaluation tool of the present invention.

As best seen in FIG. 5, load spring 70 comprises a plurality of cantilevered beams 134 which extend between upper end 130 and lower end 132 of load spring 70. Beams 134 are radially deformable responsive to the radial component of the force vector exerted by upset 128 of mandrel 44 on upset 124 and upset 126 of load spring 70 when mandrel 44 is downwardly urged by fluid pressure within interior volume 50.

In FIG. 4A, upset 124 of load spring 70 supports mandrel 44 by interfering with upset 128. After probe 52 is inserted into mandrel 44, the fluid pressure within interior volume 50 may be increased to a level sufficient to downwardly urge mandrel 44 such that upset 128 exerts a radial force on upset 124 radially deforming beams 134 and allowing mandrel 44 to slide downward relative to housing 42 aligning fluid port 98 with fluid passageway 100 to operate seal assembly 72 as described in reference to FIG. 2. When fluid port 98 and fluid passageway 100 are aligned, mandrel 44 is supported by upset 126 of load spring 70 due to interference with upset 128, as best shown in FIG. 4B.

Mandrel 44 may further shift downward relative to housing 42 by increasing the fluid pressure within interior volume 50. Since the interference between upset 126 and upset 128 is greater than the interference between upset 124 and upset 128 a higher fluid pressure is required to sufficiently radially deform cantilevered beams 134 before downward movement of mandrel 44 relative to housing 42 can be accomplished. Once sufficient fluid pressure is provided, mandrel 44 shifts downward until lower end 136 of mandrel 44 contacts shoulder 48 aligning fluid port 104 with fluid passageway 106 as shown in FIG. 4C.

Mandrel 44 may be shifted upward relative to housing 42. As mandrel 44 shifts upward, cantilevered beams 134 of load spring 70 are radially deformed as upset 128 of mandrel 44 contacts upset 126 and upset 124 of load spring 70. After upset 128 of mandrel 44 moves above upset 124 of load spring 70, mandrel 44 is supported by load spring 70.

Figure 6:
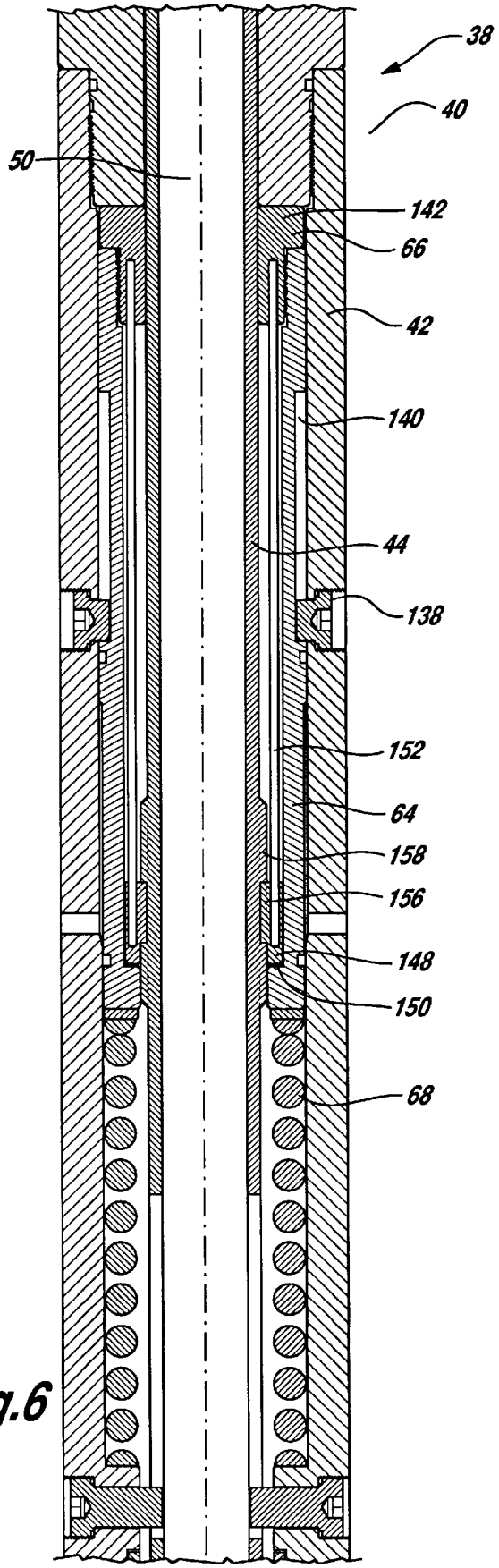
FIG. 6 is a half sectional view of a retractor section of a formation evaluation tool of the present invention.
Figure 7:
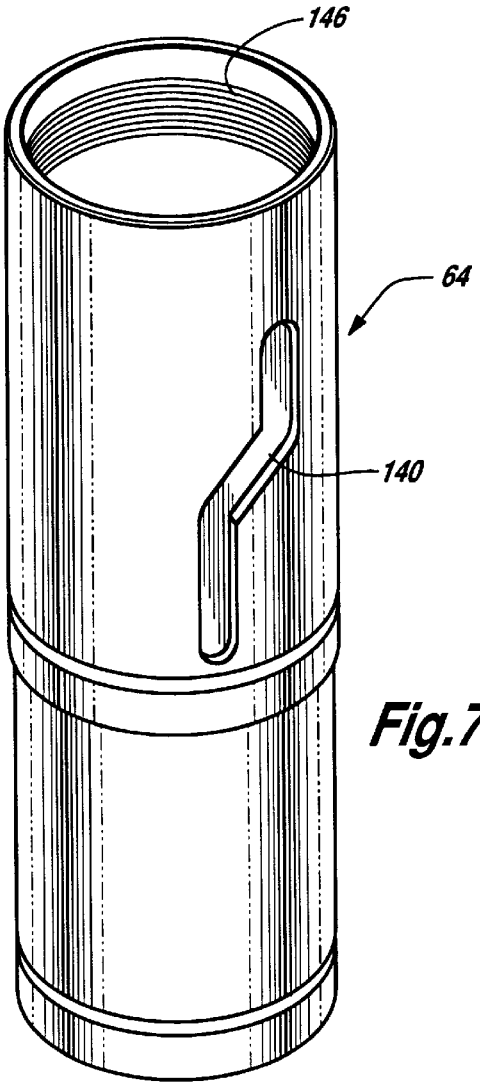
FIG. 7 is a perspective representation of a retractor sleeve of a formation evaluation tool of the present invention.

FIG. 6 depicts the upper end of formation evaluation tool 38. Retractor sleeve 64 is slidably and rotatably disposed between housing 42 and mandrel 44. Extending radially inward from housing 42 are pins 138 which slidably engage slots 140 of retractor sleeve 64 as best seen in FIG. 7. Pins 138 cause retractor sleeve 64 to rotate as retractor sleeve 64 moves axially relative to housing 42.

Figure 9:
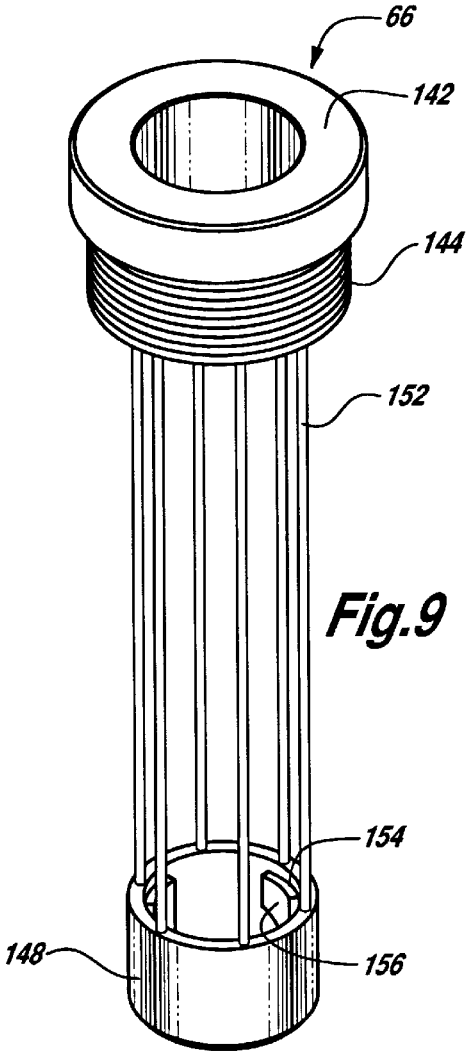
FIG. 9 is a perspective representation of a torsion spring of a formation evaluation tool of the present invention.
Figure 8:
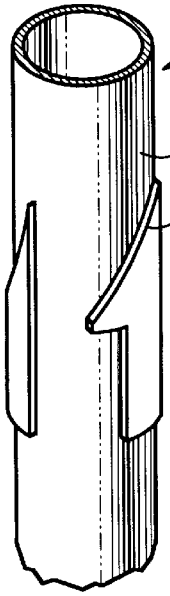
FIG. 8 is a perspective representation of a section of a mandrel of a formation evaluation tool of the present invention.

Disposed between retractor sleeve 64 and mandrel 44 is torsion spring 66. Torsion spring 66 is secured to retractor sleeve 64 proximate upper end 142 of torsion spring 66 via outer threads 144 and inner threads 146 of retractor sleeve 64 as best seen in FIG. 9. Lower end 148 of torsion spring 66 is free to rotate within retractor sleeve 64. Bearing 150 is disposed between lower end 148 of torsion spring 66 and retractor sleeve 64. Extending between upper end 142 and lower end 148 of torsion spring 66 is a plurality of rods 152. Rods 152 allow for relative rotational motion between upper end 142 and lower end 148 of torsion spring 66. Inner surface 154 of lower end 148 includes lugs 156 which are securably engagable with hooks 158 located on outer surface 160 of mandrel 44 as best seen in FIG. 8 and FIG. 9.

Disposed between mandrel 44 and housing 42 is coil spring 68. Coil spring 68 upwardly biases retractor sleeve 64. Coil spring 68 may be preloaded such that a predetermined level of fluid pressure is required to shift retractor sleeve 64 downward relative to housing 42. As coil spring 68 deforms, an increasing amount of fluid pressure is required so that the downward hydraulic force on retractor sleeve 64 can overcome the bias force of coil spring 68.

Referring to FIGS. 10A–10F, the operation of retractor sleeve 64 is depicted. Retractor sleeve 64 is disposed between housing 42 and mandrel 44. Pins 138 are at the lower ends of slots 140. Lugs 156 of torsion spring 66 are adjacent to hooks 158, as best seen in the flat development representations in FIG. 10A.

As the pressure within interior volume 50 is increased, mandrel 44 slides downward relative to housing 42 and retractor sleeve 64. As mandrel 44 slides downward, hooks 158 slide downward relative to lugs 156 of torsion spring 66 as best seen in FIG. 10B.

As the fluid pressure within interior volume 50 is further increased, the hydraulic force exerted on retractor sleeve 64 overcomes the bias force of coil spring 68 such that retractor sleeve 64 slides axially downward relative to housing 42. As retractor sleeve 64 slides downward, pins 138 travel in slots 140 such that retractor sleeve 64 rotates relative to housing 42. As retractor sleeve 64 slides axially downward and rotates, lugs 156 move toward hooks 158 as best seen in FIG. 10C. As retractor sleeve 64 continues to slide downward and rotate relative to housing 42, lugs 156 contact hooks 158.

Once contact is made between lugs 156 and hooks 158, lower end 148 of torsion spring 166 rotates relative to retractor sleeve 64 and upper end 142 of torsion spring 166 in the direction opposite the direction of rotation of retractor sleeve 64 relative to housing 42. The counter rotation between retractor sleeve 64 and lower end 148 of torsion spring 66 continues until lugs 156 are adjacent to hooks 158 and until pins 138 reach the upper portion of slots 140, as best seen in FIG. 10D. The counter rotation of lower end 148 of torsion spring 66 and retractor sleeve 64 creates stored energy within rods 152. This energy causes lugs 156 to engage hooks 158 as retractor sleeve 64 slides further downward relative to housing 42 as best seen in FIG. 10E.

In response to a decrease in the fluid pressure within interior volume 50, the biasing force of spring 68 overcomes the hydraulic force downwardly urging retractor sleeve 64 such that retractor sleeve 64 slides upward relative to housing 42. As retractor sleeve 64 slides upward relative to housing 42, lugs 156 upwardly urge hooks 158 causing mandrel 44 to slide upward relative to housing 42. Retractor sleeve 64 and mandrel 44 slide upward relative to housing 42 until upper end 142 of torsion spring 66 contacts shoulder 170 of housing 42 as best seen in FIG. 10F.

Figure 10A:
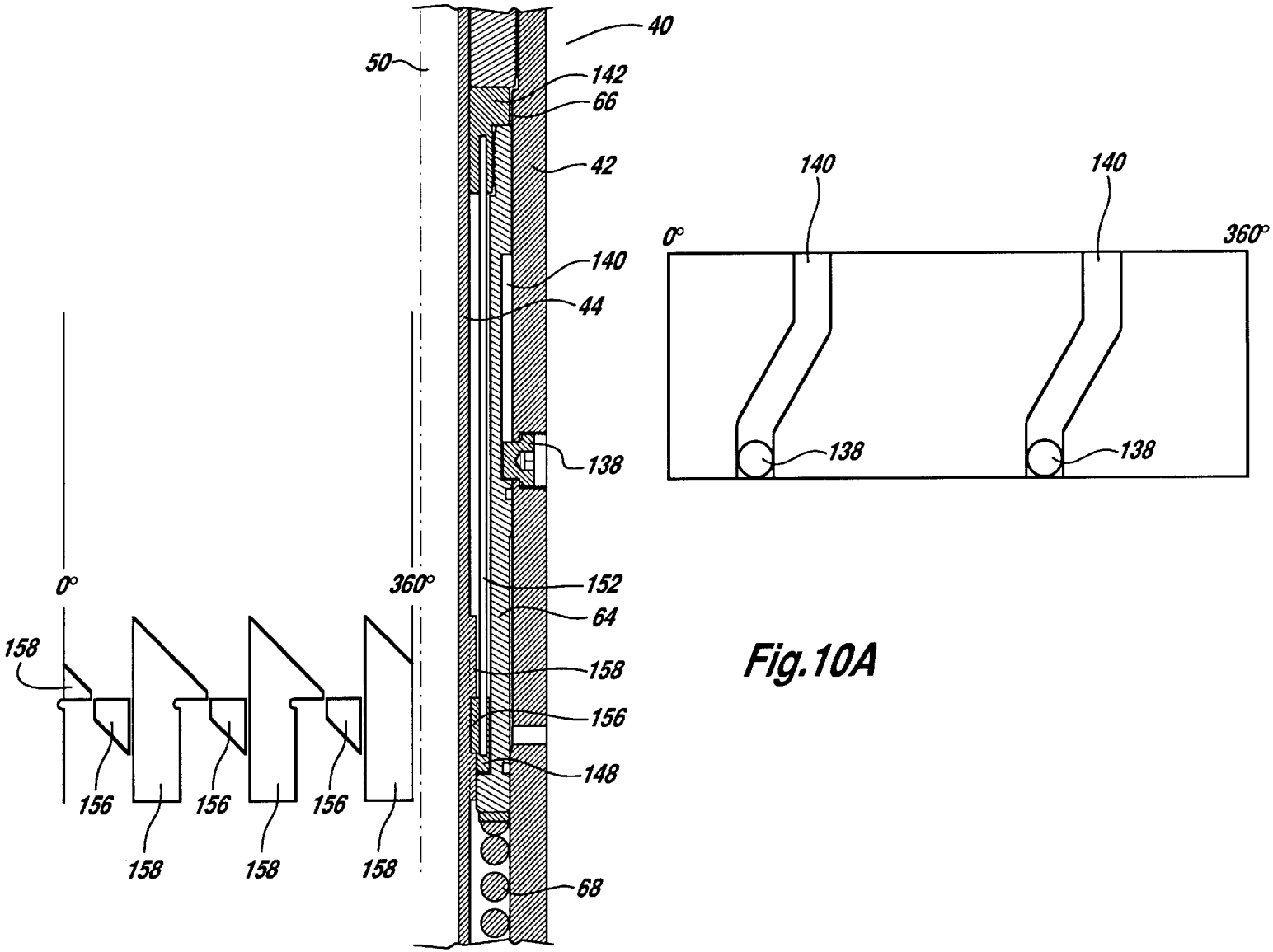
FIGS. 10A–10F are quarter sectional views having flat development representations of the interaction between a retractor sleeve, a housing, and a mandrel of a formation evaluation tool of the present invention.
Figure 10B:
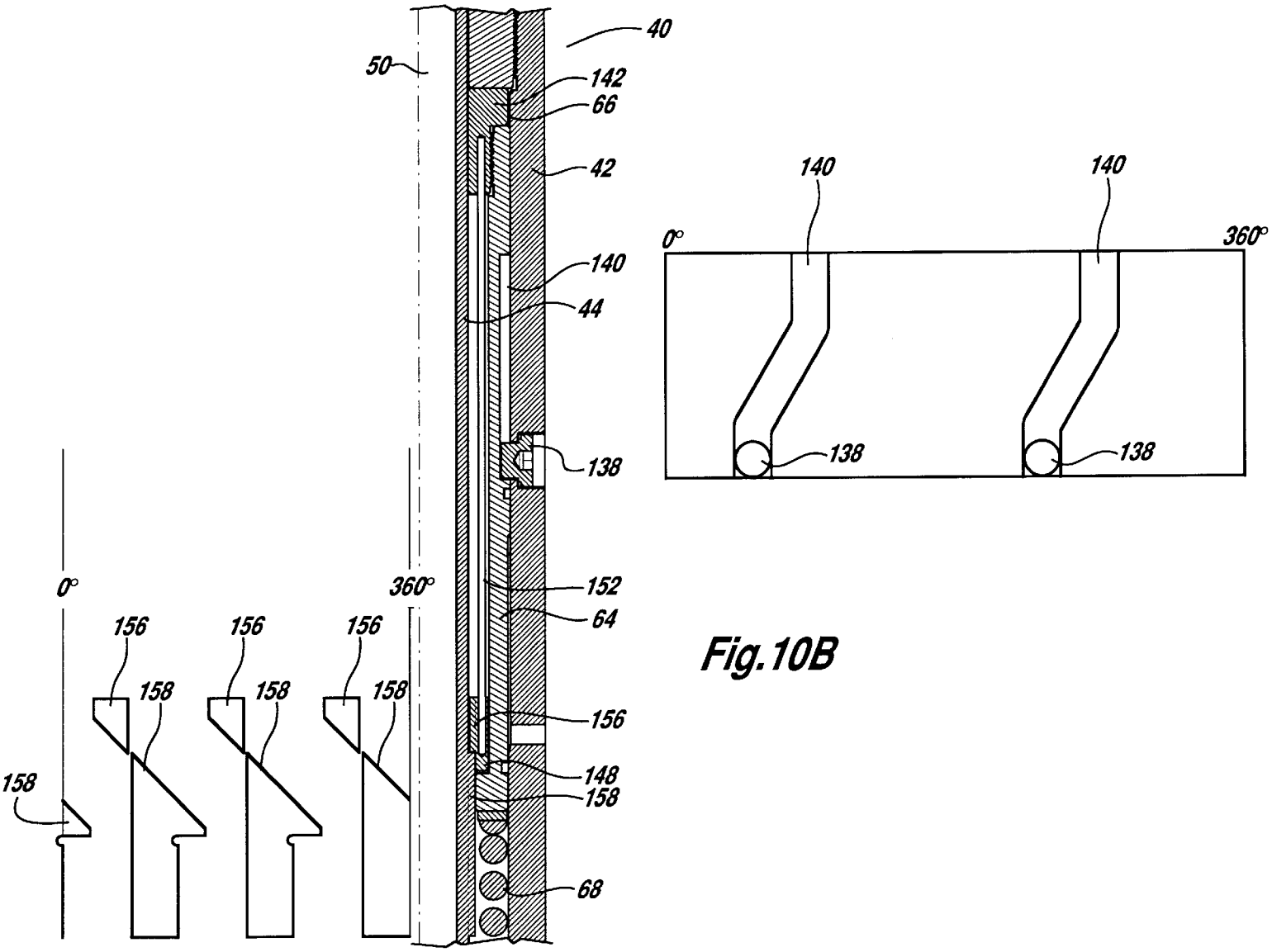
Figure 10C:
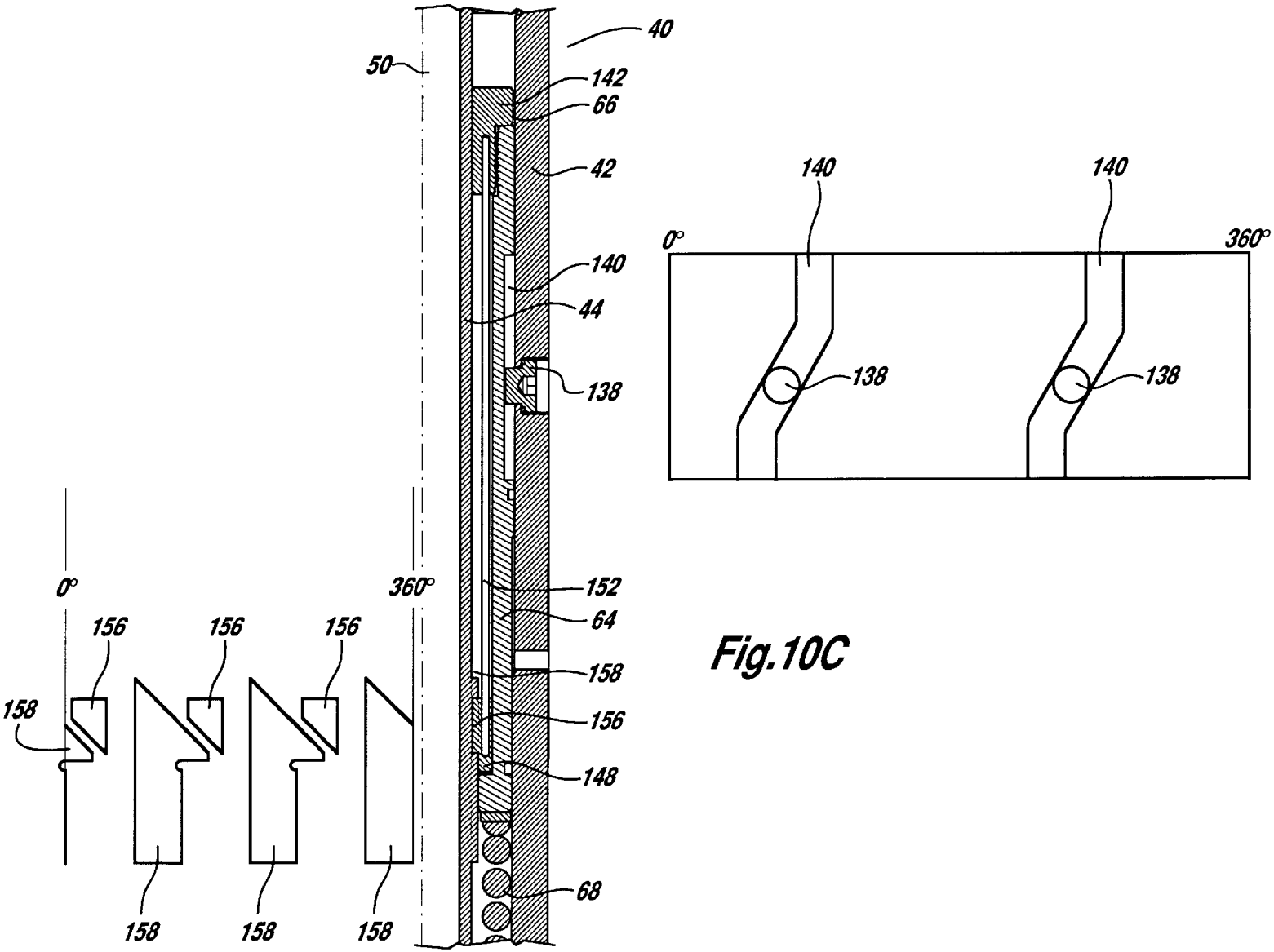
Figure 10D:
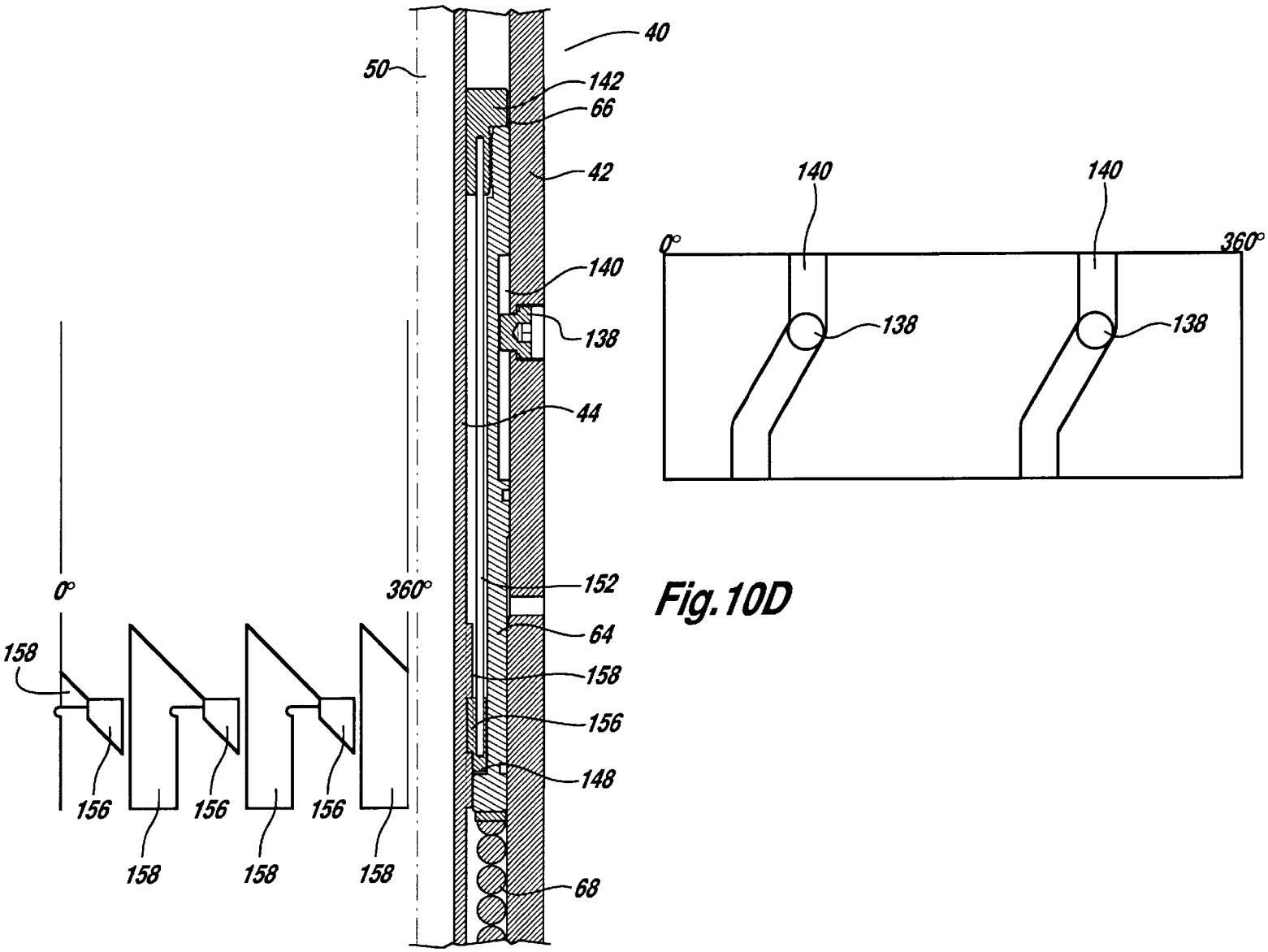
Figure 10E:
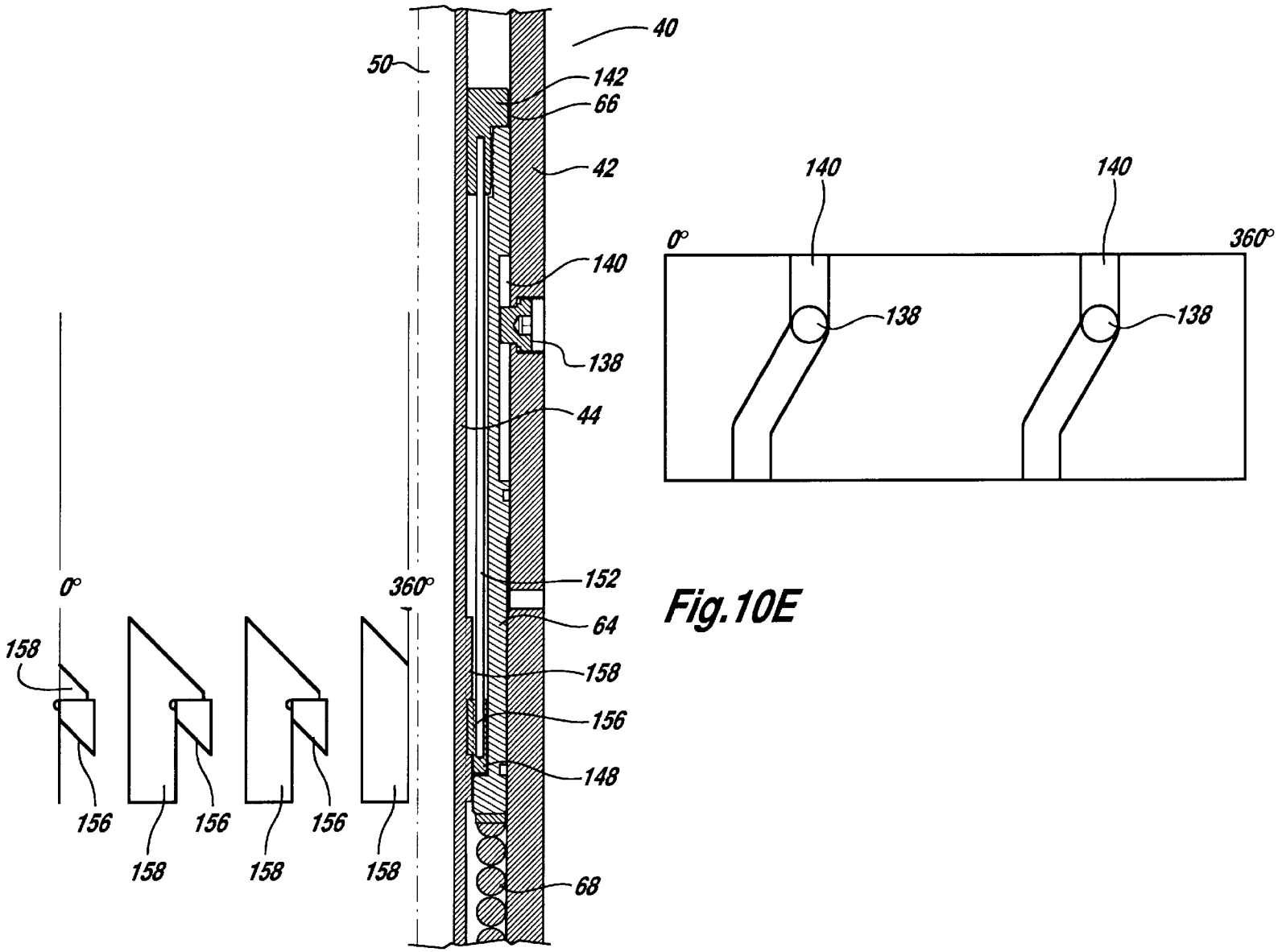
Figure 10F:
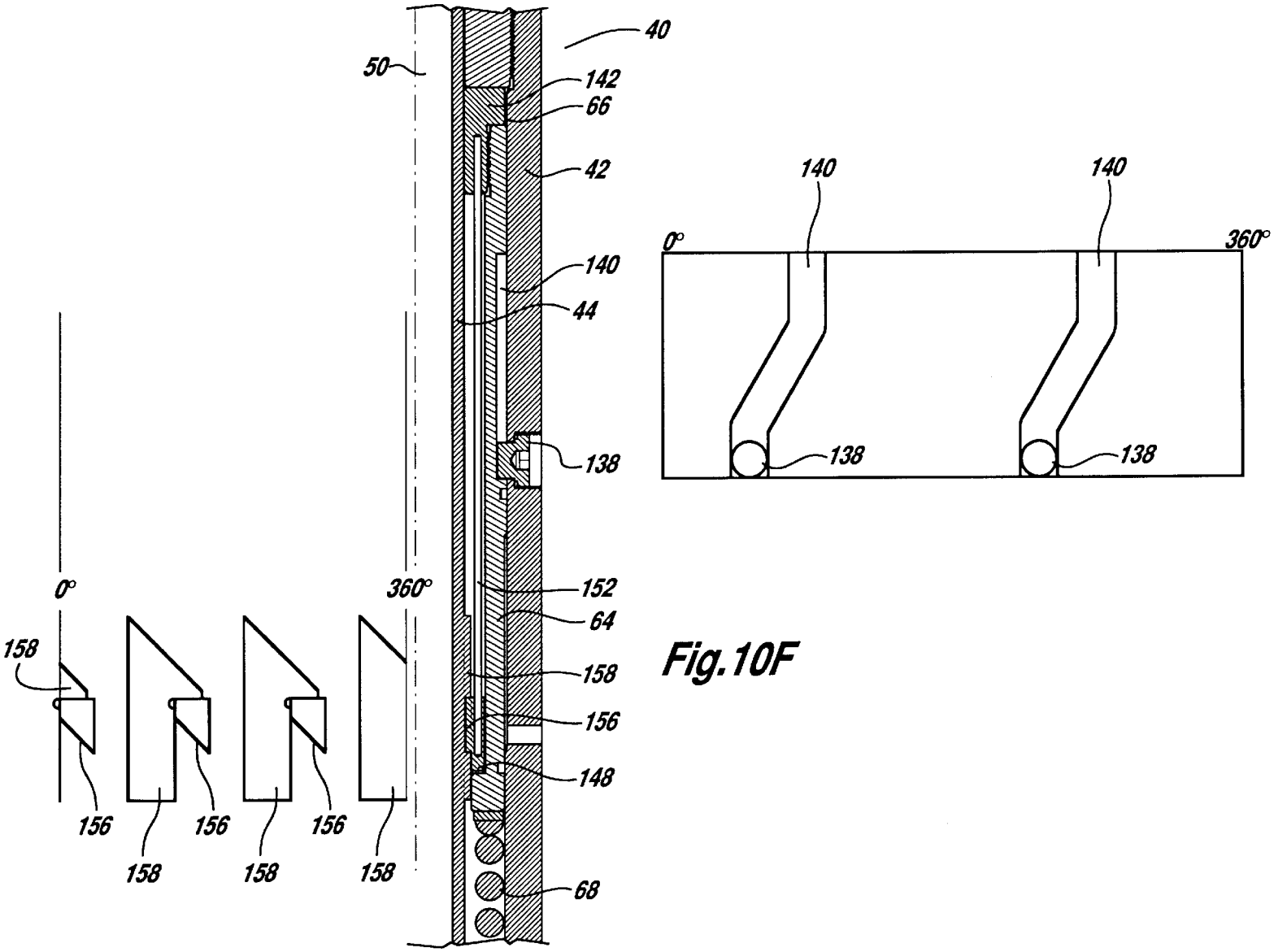

After the fluid pressure within interior volume 50 is removed, the torsion energy stored within rods 152, caused by the rotation of retractor sleeve 64 relative to housing 42 and lower end 148 of torsion spring 66 as pins 138 slide in slots 140 of retractor sleeve 64, exceeds the friction force between lugs 156 and hooks 158 such that lugs 156 disengage hooks 158 returning mandrel 44 to its original position, as best seen in FIG. 10A.

Therefore, the formation evaluation tool and method for use of the same disclosed herein has inherent advantages over the prior art. While certain embodiments of the invention have been illustrated for the purposes of this disclosure, numerous changes in the arrangement and construction of the parts may be made by those skilled in the art, such changes being embodied within the scope and spirit of the present invention as defined by the appended claims.

What is claimed is:

1. A downhole tool comprising:

a housing;

a mandrel having an interior volume and an upset, said mandrel slidably disposed within said housing and operably responsive to a fluid pressure within said interior volume; and a load spring disposed between said housing and said mandrel, said load spring having first and second upsets, said first upset interfering with said upset of said mandrel to support said mandrel and to allow said mandrel to slide axially relative to said housing when said fluid pressure within said interior volume reaches a first predetermined level, said second upset interfering with said upset of said mandrel to support said mandrel after said fluid pressure within said interior volume reaches said first predetermined level and to allow said mandrel to slide axially relative to said housing when said fluid pressure within said interior volume reaches a second predetermined level.

2. The downhole tool as recited in claim 1 wherein said housing further includes a shoulder for supporting said mandrel.

3. The downhole tool as recited in claim 1 further comprising a retractor sleeve operably associated with said housing and said mandrel, said retractor sleeve engagable with said mandrel for slidably urging said mandrel relative to said housing, said retractor sleeve slidably operated responsive to said fluid pressure within said interior volume.

4. The downhole tool as recited in claim 3 wherein said retractor sleeve defines at least one external slot and wherein said housing further includes at least one pin radially extending into said at least one slot for guiding the relative rotational motion between said retractor sleeve and said housing as said retractor sleeve slides axially relative to said housing.

5. The downhole tool as recited in claim 3 further comprising a coil spring disposed between said housing and said mandrel for biasing said retractor sleeve.

6. The downhole tool as recited in claim 3 further comprising a torsion spring having first and second ends, said first end of said torsion spring securably attached to said retractor sleeve, said second end of said torsion spring slidably rotatable relative to said retractor sleeve.

7. The downhole tool as recited in claim 6 wherein said first end and said second end of said torsion spring have a plurality of rods extending therebetween allowing relative rotational motion between said first end and said second end of said torsion spring.

8. The downhole tool as recited in claim 6 wherein said mandrel further includes at least one external hook and wherein said lower end of said torsion spring further includes a least one internal lug which is securably engagable with said at least one external hook.

9. The downhole tool as recited in claim 1 further comprising a seal assembly slidably disposed around said housing.

10. The downhole tool as recited in claim 9 wherein said seal assembly further comprises a floating piston and wherein said housing defines a fluid passageway, said floating piston and said housing define a chamber therebetween, said chamber in communication with said fluid passageway of said housing such that when said fluid pressure within said interior volume enters said chamber, said fluid pressure urges said seal assembly in a first direction.

11. The downhole tool as recited in claim 10 wherein said seal assembly further comprises first and second seal elements.

12. The downhole tool as recited in claim 11 wherein said floating piston is oriented such that said fluid pressure stretches said first and second seal elements.

13. A downhole tool comprising:

a housing having a fluid passageway and an interior volume; and a seal assembly slidably disposed around said housing, said seal assembly including a floating piston, said housing and said floating piston defining a chamber therebetween, said chamber in communication with said fluid passageway such that when a fluid pressure within said interior volume enters said chamber, said fluid pressure urges said seal assembly in a first direction.

14. The downhole tool as recited in claim 13 wherein said seal assembly further comprises first and second seal elements.

15. The downhole tool as recited in claim 14 wherein said floating piston is oriented such that said fluid pressure stretches said first and second seal elements.

16. A downhole tool comprising:

a housing;

a mandrel having an interior volume and slidably disposed within said housing; and a retractor sleeve operably associated with said housing and said mandrel, said retractor sleeve engagable with said mandrel for slidably urging said mandrel relative to said housing, said retractor sleeve slidably operated responsive to said fluid pressure within said interior volume.

17. The downhole tool as recited in claim 16 wherein said retractor sleeve is slidably rotatable relative to said housing and said mandrel.

18. The downhole tool as recited in claim 17 wherein said retractor sleeve defines at least one external slot and wherein said housing further includes at least one pin radially extending into said at least one slot for guiding the relative rotational motion between said retractor sleeve and said housing as said retractor sleeve slides axially relative to said housing.

19. The downhole tool as recited in claim 16 further comprising a torsion spring having first and second ends, said first end of said torsion spring securably attached to said retractor sleeve, said second end of said torsion spring slidably rotatable relative to said retractor sleeve.

20. The downhole tool as recited in claim 19 wherein said first and second ends of said torsion spring have a plurality of rods extending therebetween allowing relative rotational motion between said first end and said second end of said torsion spring.

21. The downhole tool as recited in claim 19 wherein said mandrel further includes at least one external hook and wherein said second end of said torsion spring further includes a least one internal lug which is securably engagable with said at least one external hook.

22. A downhole tool comprising:

a housing having a fluid passageway;

a mandrel having an interior volume, said mandrel slidably disposed within said housing, said mandrel having a plurality of positions relative to said housing, said mandrel slidably operated responsive to a fluid pressure within said interior volume such that said mandrel cycles through said plurality of positions;

a retractor sleeve operably associated with said housing and said mandrel, said retractor sleeve engagable with said mandrel for slidably urging said mandrel relative to said housing, said retractor sleeve slidably operated responsive to said fluid pressure within said interior volume; and a seal assembly slidably disposed around said housing, said seal assembly including a floating piston, said housing and said floating piston defining a chamber therebetween, said chamber in communication with said fluid passageway such that when said fluid pressure within said interior volume enters said chamber, said fluid pressure urges said seal assembly in a first direction.

23. The downhole tool as recited in claim 22 wherein said mandrel further includes an upset and wherein said housing further includes a load spring having first and second upsets which interfere with said upset of said mandrel for supporting said mandrel and allowing said mandrel to slide axially relative to said housing responsive to said fluid pressure within said interior volume.

24. The downhole tool as recited in claim 22 wherein said retractor sleeve is slidably rotatable relative to said housing and said mandrel, wherein said retractor sleeve defines at least one external slot and wherein said housing further includes at least one pin radially extending into said at least one slot for guiding the relative rotational motion between said retractor sleeve and said housing as said retractor sleeve slides axially relative to said housing.

25. The downhole tool as recited in claim 22 further comprising a torsion spring having first and second ends, said first end of said torsion spring securably attached to said retractor sleeve, said second end of said torsion spring slidably rotatable relative to said retractor sleeve, said first and second ends of said torsion spring having a plurality of rods extending therebetween allowing relative rotational motion between said first end and said second end of said torsion spring.

26. The downhole tool as recited in claim 25 wherein said mandrel further includes at least one external hook and wherein said second end of said torsion spring further includes a least one internal lug which is securably engagable with said at least one external hook.

27. The downhole tool as recited in claim 22 further comprising a coil spring disposed between said housing and said mandrel for biasing said retractor sleeve.

28. The downhole tool as recited in claim 22 wherein said seal assembly further comprises first and second seal elements and wherein said floating piston is oriented such that said fluid pressure stretches said first and second seal elements.

29. A method of operating a downhole tool comprising the steps of:

running the downhole tool into a wellbore, the downhole tool having a housing, a mandrel slidably disposed within said housing and a retractor sleeve operably associated with said housing and said mandrel;

increasing the fluid pressure inside the downhole tool;

axially sliding said mandrel relative to said housing in a first direction;

increasing the pressure inside the downhole tool;

axially sliding said retractor sleeve relative to said housing in said first direction;

rotatably sliding said retractor sleeve relative to said housing;

engaging said retractor sleeve with said mandrel;

decreasing the pressure inside the downhole tool;

axially sliding said retractor sleeve and said mandrel relative to the housing in a second direction;

decreasing the pressure inside the downhole tool; and disengaging said retractor sleeve from said mandrel.

30. The method as recited in claim 29 further including the steps of connecting the downhole tool proximate the lower end of a drill string above a drill bit and drilling said wellbore.

31. The method as recited in claim 29 further including the step of inflating first and second seal elements to isolate a formation.

32. The method as recited in claim 31 further including the step of deflating said first and second seal elements.

33. The method as recited in claim 29 further including the step of slidably urging a floating piston to stretch a seal element.

34. The method as recited in claim 29 further including, after the step of axially sliding said mandrel relative to said housing in a first direction, the steps of increasing the pressure inside the downhole tool and axially sliding said mandrel relative to said housing in said first direction.

35. The method as recited in claim 29 further including, after the step disengaging said retractor sleeve from said mandrel, the step of drilling said wellbore.

* * * * *

UNITED STATES PATENT AND TRADEMARK OFFICE

CERTIFICATE OF CORRECTION

PATENT NO. : 5,813,460
DATED : September 29, 1998
INVENTOR(S) : Ringgenberg et al.

It is certified that error appears in the above-identified patent and that said Letters Patent is hereby corrected as shown below:

Column 7,
Lines 21 and 22, "torsion spring 166" should read -- torsion spring 66 --.

Signed and Sealed this

Seventh Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,813,460
DATED : September 29, 1998
INVENTOR(S) : Ringgenberg et al.

It is certified that error appears in the above-identified patent and that said Letters Patent is hereby corrected as shown below:

Column 9,
Line 21, “said” should read -- a --.

Column 10,
Line 47, “the” before the word “fluid” should read -- a --.

Signed and Sealed this

Third Day of February, 2004

JON W. DUDAS
*Acting Director of the United States Patent and Trademark Office*